United States Patent [19]

Guert

[11] Patent Number: 4,462,393

[45] Date of Patent: Jul. 31, 1984

[54] MANUAL MASSAGE INSTRUMENT

[75] Inventor: Jean-Louis H. Guert, Paris, France

[73] Assignee: L'Oreal, Paris, France

[21] Appl. No.: 424,391

[22] Filed: Sep. 27, 1982

Related U.S. Application Data

[63] Continuation of Ser. No. 194,492, Oct. 6, 1982, Pat. No. 4,409,967.

[30] Foreign Application Priority Data

Oct. 23, 1979 [FR] France ..... 79 26255

[51] Int. Cl.[3] ..... A61H 7/00

[52] U.S. Cl. ..... 128/62 R; 128/67

[58] Field of Search ..... 128/62 R, 62 A, 67; 15/5, 110, 141 R, 159, 187, 188, 190, 195, 196, 186, 104.94

[56] References Cited

U.S. PATENT DOCUMENTS 3,691,585 9/1972 Flom ..... 15/187

3,867,928 2/1975 Tupper ..... 128/67

3,886,619 6/1975 Natman ..... 15/187

FOREIGN PATENT DOCUMENTS 922011 10/1948 France ..... 128/67

519645 3/1953 France ..... 128/67

2019220 10/1979 United Kingdom ..... 128/67

*Primary Examiner*—Richard J. Apley

*Assistant Examiner*—David J. Brown

*Attorney, Agent, or Firm*—N. Jerome Rudy

[57] ABSTRACT

A massage instrument or appliance for the skin which comprises at least one active face on which there are provided a plurality of projecting spikes made of a flexible, elastically deformable material, wherein the spikes are constituted by non-intersecting plates and are distributed in accordance with the angular orientation of their plates in at least two groups, the spikes of a same group being disposed, on the active face of the instrument, so as to alternate with the spikes of another same group.

10 Claims, 2 Drawing Figures

MANUAL MASSAGE INSTRUMENT

HISTORY OF THE APPLICATION

The present application is a continuation of co-pending application by the present Applicant for U.S. Letters Patent entitled "Manual Massage Instrument" having Ser. No. 194,492 which was filed Oct. 6, 1982, now U.S. Pat. No. 4,409,967, issued Oct. 18, 1983.

BACKGROUND OF THE INVENTION

1. Field of the Invention

The present invention relates to a manually operated massage instrument or appliance designed to cause a localized hyperaemia in the areas of the skin subjected to the massage. This localized hyperaemia consists in a congestion of the blood due to an activation of the underlying circulation, and facilitates the penetration of suitable substances. It is possible, therefore, to profit from this effect in particular in the field of cosmetics, in order to enable penetration of various creams or lotions into the area of the skin which has been congested by massage.

2. Description of the Prior Art

Present massage instruments include the friction glove and the massage brush, the latter having a plurality of spikes or points on its active surface which, on contact with the skin, cause a slight depression in the skin and consequently a localized hyperaemia.

In the French Patent Application No. 78-12063 filed on Apr. 24, 1978, (now published as French Pat. No. 2,424,022 issued May 24, 1982) there is disclosed a massage brush whose active surface is provided with asymmetrical spikes made of an elastically deformable, flexible material each having a concave portion and an opposite convex portion. The above-mentioned asymmetrical spikes in effect have a greater bending stength when their convex portion is used and a lower strength when their concave portion is used. In addition, the spikes are disposed facing away from one another, i.e. one spike having its concave portion facing in one direction is adjacent to a spike having its concave portion facing in the other direction.

The above massage instrument provides a double advantage: in the first instance, the efficiency of the skin massage is improved greatly in comparison with the massage obtained by known massage instruments such as a friction glove. In effect, the friction on the skin caused by spikes having alternating zones whose bending strength in the direction of displacement of the applicator is high and zones whose bending strength in the same direction is lower, causes on the sking the formation of wave-like or sinuous depressions which are displaced on the skin simultaneously with the massage instrument. In addition, as the spikes are made of an elastically deformable, flexible material, a brush of this type allows forceful massage of the skin without the risk of lesions or abrasions of the epidermal layers whilst adapting completely to the various morphologies of users.

SUMMARY OF THE INVENTION

It is an object of the present invention to provide yet another massage instrument having spikes which are preferably symmetrical and which have alternate less flexible and more flexible portions. According to the invention, the spikes are constituted by non-intersecting plates which have, on one hand, a higher bending strength and consequently a "harder" contact on the skin if the faces of the plates constituting the spikes are used and, on the other hand, a lower bending strength and consequently a "softer" contact if one of the sides of the plates of the spikes is used. The spikes all have the same shape but are disposed with at least two different angular orientations, so that in the case of rectilinear massage the region of the skin on which the massage instrument of the invention is displaced is subjected to the action of alternating hard and soft spikes.

The present invention therefore provides a massage instrument for massaging the skin, on at least one active face of which instrument there are provided a plurality of projecting spikes made of a flexible, elastically deformable material, wherein the spikes are constituted by non-intersecting plates and are distributed in accordance with the angular orientation of their plates in at least two groups, the spikes of a same group being disposed, on the active face of the instrument, so as to alternate with the spikes of another same group.

In a preferred construction, the spikes are constructed in one piece with their support from a flexible, rubbery material; the plates constituting the spikes are substantially disposed at right angles on their support and have the shape of the segment of a circle which is connected by its chord to the support; and the surrounding surface of the face of the plates belonging to each spike has substantially the shape of a spherical portion. The spikes are constituted by non-intersecting plates which are substantially parallel, the plates of the spikes of a same group being orientated angularly with respect to the plates of the spikes of another same group. The spikes are preferably disposed in four groups, the plates of the spikes of a same group being orientated at 45° or a multiple thereof with respect to the plates of the spikes of another same group.

In the present invention, thereof the spikes may be equally well disposed in substantially parallel rows or along wave-like lines; two wave-like lines then being in phase opposition, or in concentric circles.

The massage instrument of the invention may comprise a massage brush, whose flexible support for the spikes is inserted within a rigid frame which may or may not be connected to a handle; the massage instrument may alternatively be a massage glove, i.e. a flexible bag on at least one of the surfaces of which project the spikes defined above. The massage instrument of the invention may be used not only for massage but also for the simultaneous washing of the skin. In this case, as disclosed in the first French Application of Addition No. 78-34330 filed on Dec. 6, 1978, the flexible support which bears the spikes may be provided with perforations and associated with a container designed to contain a hydrosoluble product, for example a bar of soap.

DETAILED DESCRIPTION OF THE DRAWING

Figure 1:
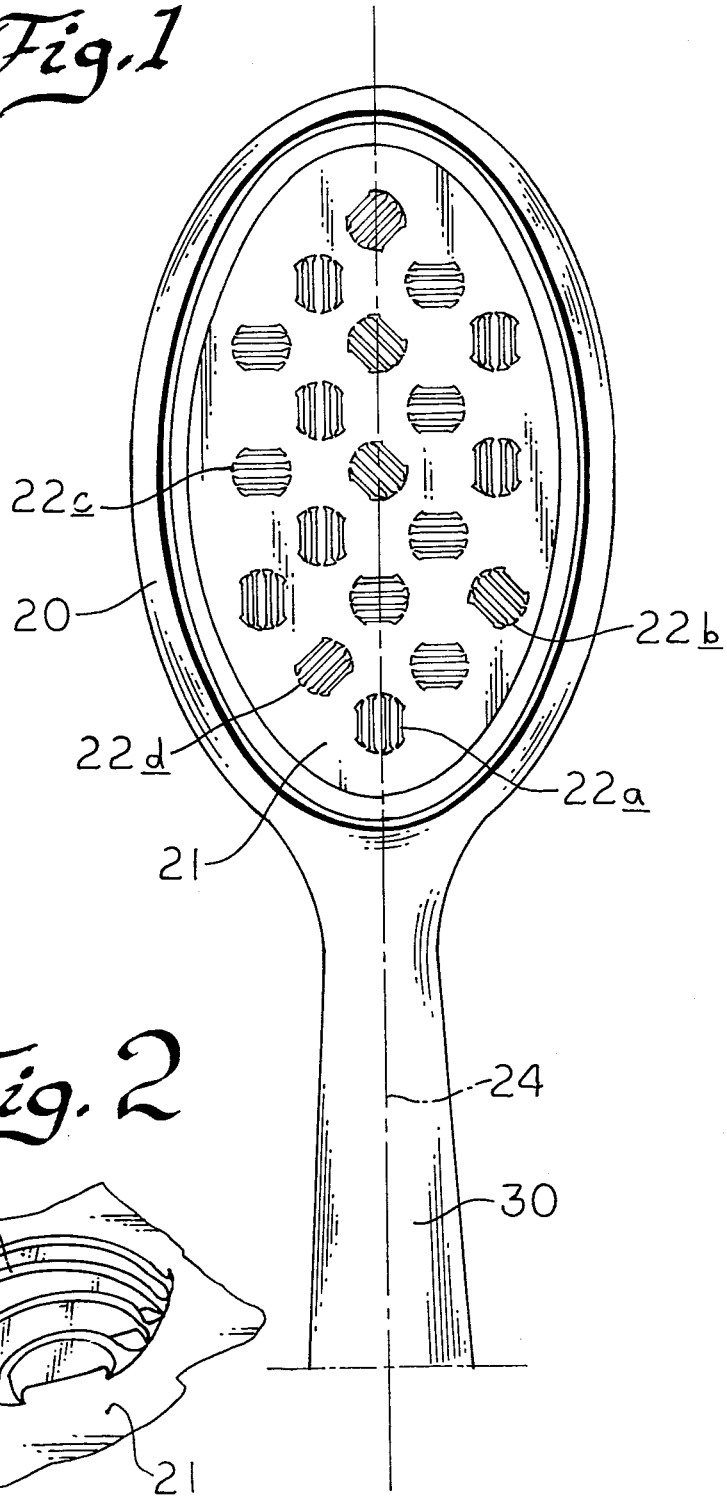
Figure 2:
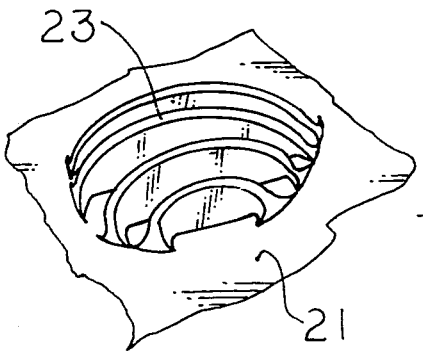

FIG. 1 is a plan view of a massage brush in accordance with the invention; and FIG. 2 is a perspective view, on an enlarged scale, of one of the spikes of the brush of FIG. 1.

DESCRIPTION OF THE PREFERRED EMBODIMENTS

FIGS. 1 and 2 of the drawing show an embodiment of a massage brush according to the invention. The appliance has a frame 20 integral with a handle 30. The frame 20 is provided with a substantially elliptical cavity within which there is mounted a flexible support 21. Most advantageously, four groups of spikes 22*a*, 22*b*, 22*c*, 22*d* are provided and project from the flexible support 21. The spikes 22*a*, 22*b*, 22*c*, 22*d* are integral with the flexible support 21 and are made from a rubbery material.

The spikes are disposed in a lattice having a square mesh on the flexible support 21. The spikes 22*a*, 22*b*, 22*c*, 22*d*, all have the same shape, and only their relative angular orientation is different. The spikes 22*a*, 22*b*, 22*c*, 22*d* each comprise four substantially parallel plates 23 connected at right angles to the flexible support 21. Each plate has the shape of the segment of a circle which is connected by its chord to the flexible support 21. The surrounding surface of the face of the four plates 23 of a spike has the shape of a spherical portion. The plates 23 have, in the vicinity of their ends, a slightly increased thickness.

As can be seen from FIG. 1, the plates of the spikes 22*a* are parallel to the longitudinal axis 24 of the brush, while the plates of the other spikes 22*b*, 22*c* and 22*d* are oriented as shown. The plates 23 of the spikes of a same group 22*a*, 22*b*, 22*c*, 22*d* are orientated at 45° or a multiple thereof with respect to the plates 23 of the spikes of another group. The spikes of a same group alternate with spikes of the other groups on the flexible support 21.

If the massage brush shown in FIGS. 1 and 2 is displaced parallel to its axis 24 on the sking, the action of the spikes 22*a* is made on the face of the plates 23, whilst the action of the spikes 22*c* is made perpendicularly on the sides of the plates 23. The action of the spikes 22*b* and 22*d* also takes place laterally but with an angle of incidence of 45°. The plates 23 of the spikes 22*b*, 22*c*, 22*d* are consequently acted upon laterally and therefore have a lower bending strength than the plates of the spikes 22*a* which are acted upon by their face. Thus, by displacing the massage brush parallel to its axis 24, the skin comes into contact with the spikes 22*a* which appear "harder" than the spikes 22*b*, 22*d* which are themselves slightly harder than the spikes 22*c*.

A very good massage action is produced by the brush appliance embodied as shown.

It should also be noted that the brush appliance here involved, as a result of the flexible material from which the spikes 22*a*, 22*b*, 22*c*, 22*d* are made and as a result of the rounded shape of the non-intersecting plates which constitute them, are unable to cause either abrasion or destruction by friction of the epidermal layers, even if energetic massaging is carried out.

It should be understood that the embodiments described above are in no way limiting and may include any desirable modifications without departing from the scope of the invention.

I claim:

1. A massage appliance for the skin, comprising:

(a) at least one active face (a), there being provided on each said active face (a)

(b) an array of a plurality of groups of projecting spikes, each of which is made up of an elastically-deformable, flexible material; with each of said spikes (b) being made up of (c) at least two non-intersecting plates displaced so as to uprightly-extend from each of said active faces (a) on which said spike groups (b) are provided, with said non-intersecting plates being so disposed and arranged in respective angular orientation relative one to another as to be at least substantially parallel and spaced apart in side-by-side relationship; and with each of said respective spike groups (b) provided in said array on each said active face (a) being disposed relative to one another in relative spaced alignment and in a randomly alternating aligned arrangement one relative to the next with alternate spikes in said spike groups (b) having differing orientation angulations in their given non-intersecting plates (c) therein, so that the plates (c) of the spike in said spike groups (b) which are in any given same group are oriented angularly with respect to the plates (c) of the spikes of another given same spike group in the said spike groups array (b) and are arranged such that the spikes of said given same group randomly alternate on each active face (a) on which they are provided with said spikes of said other given same spike group or groups.

2. The appliance of claim 1, wherein the spikes in said spike groups (b) are constructed integral with a support therefor.

3. The appliance of claim 1, wherein the plates (c) making up the spikes in said spike group (b) are disposed substantially at right angles on a support therefor and have the shape of the segment of a circle connected by its chord to the support.

4. The appliance of claim 1, wherein the surrounding surface of the face of the plates (c) of each spike in said spike groups (b) has substantially the shape of a spherical portion.

5. The appliance of claim 1, wherein the spikes in said spike groups (b) are distributed in four groups, with the plates (c) of the spikes of (a) any given same group being oriented at a 45° angulation or (a) some multiple thereof with respect to the plates (c) of the spikes of another given same group.

6. The appliance of claim 1, when the same is in the form of a massage brush, with (a) the support for the spikes in said spike groups (b) being disposed within a rigid frame.

7. The appliance of claim 1, wherein (a) the support for the spikes in said spike groups (b) is provided with perforations and is further associated with a receptacle designed to contain a hydrosoluble product.

8. An apparatus in accordance with any one of those of claims 2, 3, 6 or 7, inclusive, wherein said spikes in said spike group (b) and said support are constituted of a rubbery material of construction.

9. An apparatus in accordance with that of claim 4, wherein said spikes in said spike group (b) and the at least one active face (a) on which they are provided are constituted of a rubbery material of construction.

10. An apparatus in accordance with that of claim 5, wherein said spikes in said spike group (b) and the at least one active face (a) on which they are provided are constituted of a rubbery material of construction.

* * * * *